United States Patent [19]

Serio

[11] 3,967,323

[45] July 6, 1976

[54] THERAPEUTIC CONSTANT FLOW BATH

[76] Inventor: Jeannette H. Serio, 27 Orange Ave., Natchez, Miss. 39120

[22] Filed: Dec. 31, 1974

[21] Appl. No.: 537,659

[52] U.S. Cl. ..... 4/173 R; 4/178; 4/181; 128/66

[51] Int. Cl.[2] ..... A47K 3/00; A61H 33/00

[58] Field of Search ..... 4/173, 181, 180, 6, 4/178, 182; 128/66, 248

[56] References Cited

UNITED STATES PATENTS

| | | | |
|---|---|---|---|
| 2,705,329 | 4/1955 | Exton-Porter | 4/173 |
| 3,001,208 | 9/1961 | Rosoff | 4/182 |
| 3,034,137 | 5/1962 | Glou | 4/6 |
| 3,072,918 | 1/1963 | McCall et al. | 4/6 |
| 3,247,969 | 4/1966 | Miller | 4/178 X |
| 3,366,110 | 1/1968 | Gaylord, Jr. | 128/248 |
| 3,374,492 | 3/1968 | Ruderian | 4/178 |
| 3,441,015 | 4/1969 | Oatman et al. | 128/66 |
| 3,548,815 | 12/1970 | Everston | 128/66 |
| 3,614,952 | 10/1971 | Agnellino | 4/178 |

*Primary Examiner*—Henry K. Artis
*Attorney, Agent, or Firm*—Clarence A. O'Brien; Harvey B. Jacobson

[57] ABSTRACT

A therapeutic constant flow bath having a tank forming a container for a liquid bath. The tank is provided with inlets disposed at the bottom of the tank and outlets disposed at the normal surface level of the liquid bath in the tank for permitting a continuous bottom-to-top flow of liquid through the tank. The outlets are divided into sets formed in opposed sidewalls of the tank, while the intakes are also divided into sets arranged adjacent the tank sidewalls for creating a desired flow pattern in the bath.

8 Claims, 4 Drawing Figures

THERAPEUTIC CONSTANT FLOW BATH

BACKGROUND OF THE INVENTION

1. Field of the Invention

This invention relates generally to hydrotherapy apparatus, and particularly to a therapeutic constant flow bath.

2. Description of the Prior Art

It is known to employ a constant flow of liquid through a therapeutic bath in order to, among other things, maintain the liquid in the bath at a constant temperature, prevent contaminated liquid from building up in the bath, and direct a beneficial current of liquid against the body of a bather. Examples of known arrangements for achieving the constant flow of liquid through a bath may be found in pertinent prior patents as follows:

| | | |
|---|---|---|
| 2,004,825 | G. D. Morgans | June 11, 1935 |
| 2,705,329 | A. R. Exton-Porter | Apr. 5, 1955 |
| 3,441,015 | E. T. Oatman et al | Apr. 29, 1969 |
| 3,520,296 | E. T. Oatman et al | July 14, 1970 |

SUMMARY OF THE INVENTION

It is an object of the present invention to provide a therapeutic constant flow bath that is simple in construction, yet efficient and effective in operation.

It is another object of the present invention to provide a therapeutic constant flow bath having improved liquid flow characterisitcs when compared to known devices of this kind.

It is yet another object of the present invention to provide a constant flow bath construction that permits an external appearance similar to a conventional bathtub, and which may be installed in the manner of a conventional bathtub.

These and other objects are achieved according to the present invention by providing a therapeutic constant flow bath having: a tank forming a container for a liquid bath; a plurality of inlets arranged beneath a predetermined normal surface level of the liquid bath for continuously feeding liquid into the tank; and a plurality of outlets arranged at the surface level of the liquid bath for continuously draining liquid from the tank.

Advantageously, the inlets and outlets are each divided into a pair of sets, with the sets of outlets being respectively disposed in opposed sidewalls of the tank and the sets of inlets being disposed in the bottom wall of the tank adjacent the aforementioned sidewalls. In this manner, desirable currents are effected in the bath contained in the tank.

Each outlet preferably includes a slot provided in the sidewall of the tank associated with the outlet in question, and this slot is arranged substantially coplanar with each other outlet slot. A conversion chamber provided within the associated sidewall and arranged converging away from the slot connects the slot with a respective one of a pair of discharge passages formed within the sidewalls. These passages, which connect the outlets to a common drain, slope away from the bottom wall of the tank in a direction away from the drain for permitting the liquid received by the outlets provided in the tank to flow under the force of gravity into the drain and away from the tank.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 4:
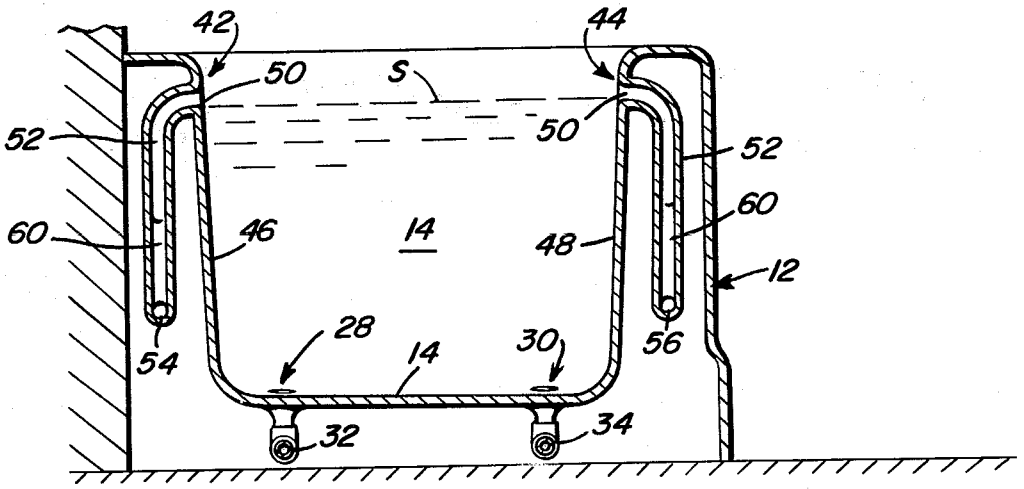
FIG. 4 is a fragmentary, sectional view taken generally along the line 4—4 of FIG. 3.

A therapeutic constant flow bath 10 according to the present invention includes a tank 12 forming a container for a liquid bath 14 (FIG. 4). An inlet arrangement 16 is arranged beneath a predetermined normal surface level S (FIG. 4) of liquid bath 14 for continuously feeding a liquid into tank 12, while an outlet arrangement 18 is arranged at the surface level A of liquid bath 14 for continuously draining liquid from tank 12. In this manner, a continuous upward flow of liquid through bath 14 may be readily obtained and maintained.

Inlet arrangement 16 advantageously includes a plurality of inlets 20 connected to a common source of liquid as by a conventional valve 22 itself connected to, for example, conventional household hot and cold water plumbing. A pipe 24 and a manifold 26 connect valve 22 to a pair of sets 28 and 30 of inlets 20, themselves connected together and to manifold 26 as by pipes 32 and 34. That is, inlets 20 are divided into a pair of sets 28, 30 with each of inlets 20 of each one of sets 28, 30 being connected together. Tank 12 has a bottom wall 36 in which inlets 20 are provided and directed upwardly toward surface level S in tank 12 for facilitating the desired upward flow of the liquid being fed into tank 12 through inlets 20.

Figure 1:
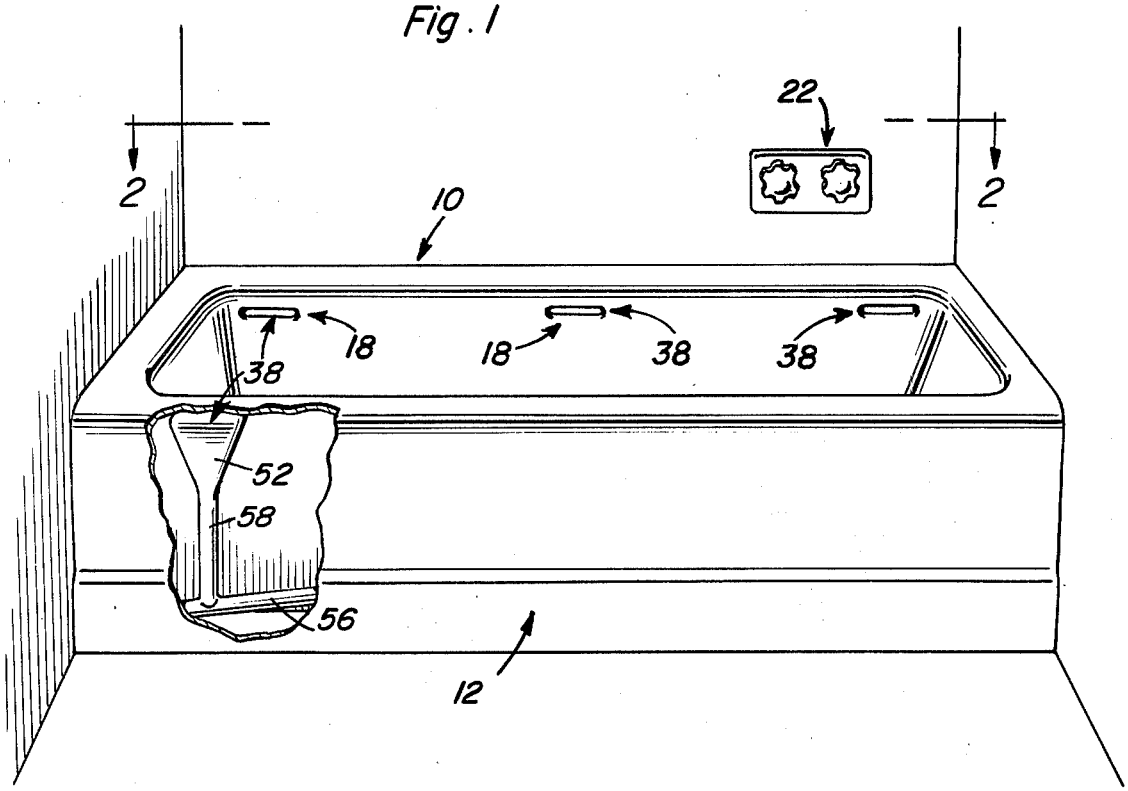
FIG. 1 is a fragmentary, perspective view, partly cutaway and in section, showing a therapeutic constant flow bath according to the present invention.
Figure 2:
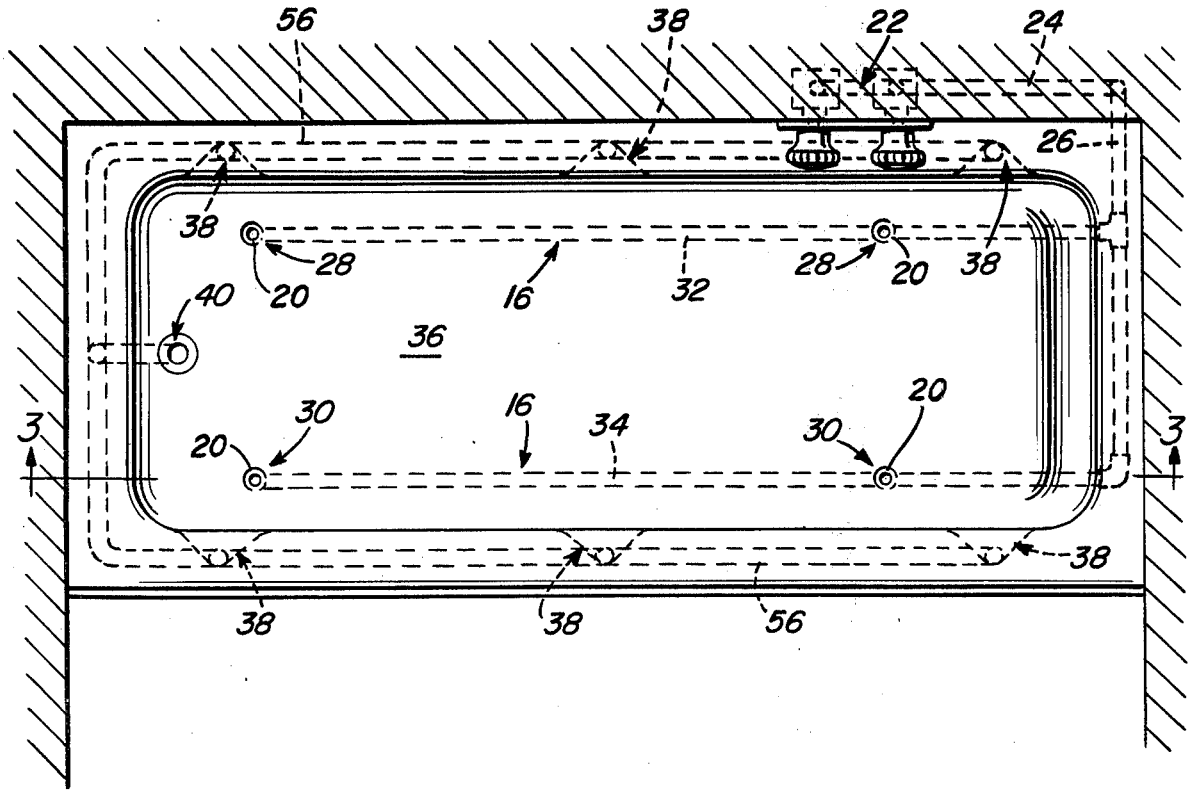
FIG. 2 is a fragmentary, sectional view taken generally along the line 2—2 of FIG. 1.
Figure 3:
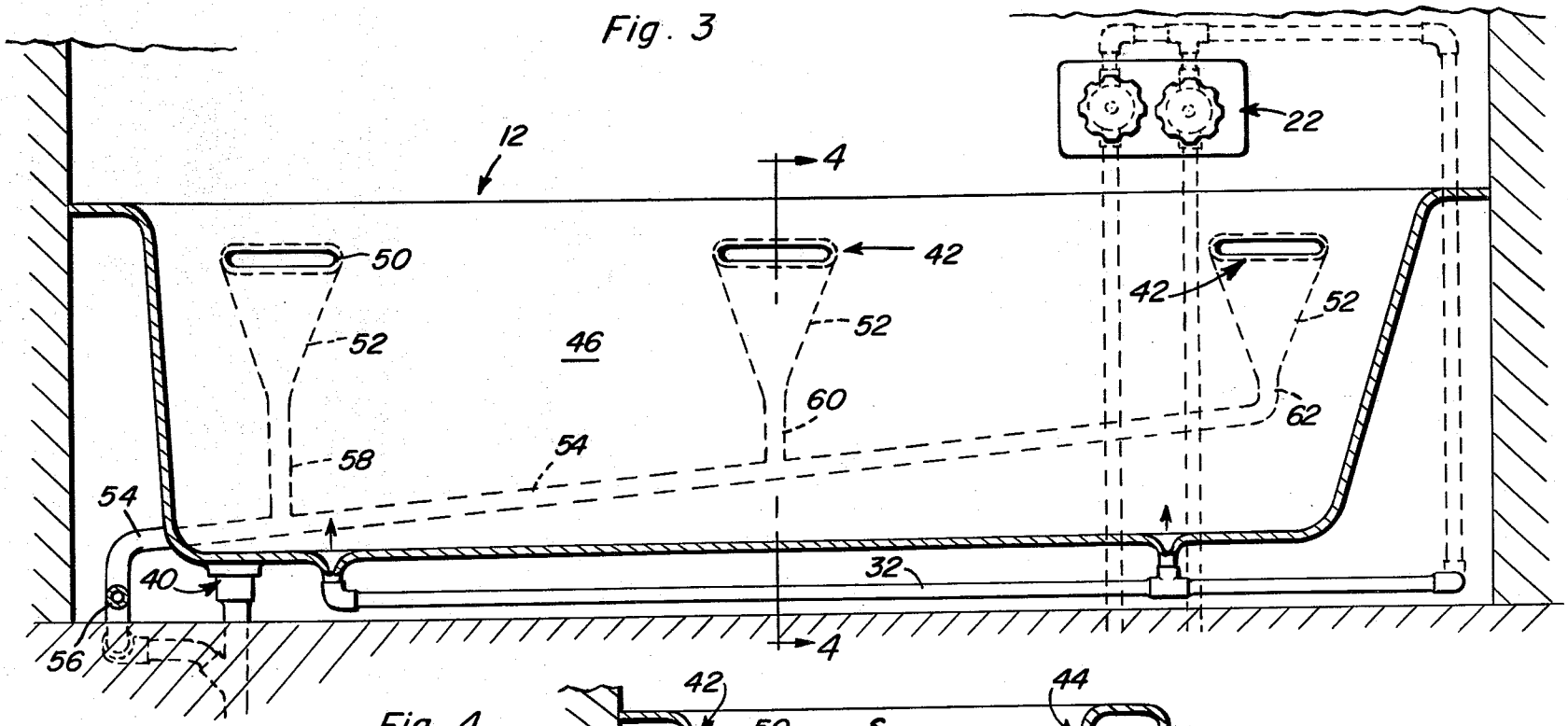
FIG. 3 is a fragmentary, sectional view taken generally along the line 3—3 of FIG. 2.

Outlet arrangement 18 includes a plurality of outlets 38 connected to a common drain 40. While it is advantageous to combine drain 40 with the conventional bathtub drain as is shown in FIGS. 2 and 3 of the drawings, it will be appreciated that drain 40 may be separate from the drain in the bottom of tank 12 if so desired. Outlets 38 are divided into a pair of sets 42 and 44, with each of outlets 38 of each one of sets 42, 44 being connected together as well as to drain 40. Tank 12 has opposed sidewalls 46 and 48 extending from bottom wall 36, and outlets 38 are advantageously provided in sidewalls 46, 48. One of sets 42, 44 is provided in one of sidewalls 46, 48, while the other of sets 44, 42 is provided in the other of the sidewalls 48, 46. As can be readily seen in FIG. 2 of the drawings, each of the sets 28, 30 of inlets 20 is arranged parallel to and adjacent a respective one of sidewalls 46, 48. In this manner, the sets of inlets and outlets are grouped together, with one set of inlets and one set of outlets forming a group. Further, each group is disposed either on or in the proximity of a respective one of the sidewalls 46, 48.

Each outlet 38 inlcudes a slot 50 provided in the sidewall 46, 48 associated with the outlet 38 and is arranged substantially coplanar with each other outlet slot 50. A converging chamber 52 is provided within the associated sidewall 46, 48, and is arranged converging away from the slots 50 associated with the chamber 52. Outlet arrangement 18 further includes a pair of discharge passages 54 and 56, one of which passages 54, 56 is provided within one of sidewalls 46, 48 and the other of the discharge passages 56, 54 provided within the other of the sidewalls 48, 46. Discharge passages 54, 56 are connected to chambers 52 at the converging, or lower, ends of chambers 52. Thus, chambers 52 are arranged between slots 50 and passages 54, 56. Further, passages 54, 56 are sloped away from bottom wall 36 of tank 12 in a direction away from drain 40 in order to facilitate drainage of liquid passed through slots 50 toward drain 40. Stems 58, 60 and 62 are provided for connecting the converging ends of chambers 52 to the associated passages 54, 56. As will be appreciated, while these stems 58, 60, and 62 are similar in construction, they vary in length due to the slope of passages 54 and 56. This arrangement can be readily appreciated from FIG. 3 of the drawings.

As will be readily understood from the above description and from the drawings, bath 10 according to the invention may be operated by manually manipulating the, for example, hot and cold water knobs provided on valve 22 and causing a liquid, such as water at a predetermined temperature, to flow through inlets 20 and into tank 12. When the surface level S in tank 12 has reached the height of slots 50, the liquid will commence flowing out of tank 12 through slots 50, and the level of the liquid in tank 12 will remain substantially constant as long as the liquid continues to flow in through inlets 20. By proper design, it will be appreciated that the amount of liquid entering tank 12 through inlets 20 can be limited to that amount of liquid which can be handled by the plurality of slots 50 which partially form the outlets 38.

It will be appreciated that as an alternative to arranging inlets 20 in bottom wall 36 adjacent the sidewalls 46, 48, the inlets may actually be arranged in the lower portion of the sidewalls in a manner not shown. Further, if the inlets were arranged in the lower portion of the sidewalls, it would be advantageous to slant the direction of flow of the liquid into the tub. In addition, the location and/or type of valve 22 employed to control the flow of liquid into tank 12 may vary as circumstances, such as existing plumbing, dictate.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A therapeutic constant flow bath, comprising, in combination:

a. a tank forming a container for a liquid bath;

b. inlet means arranged beneath a predetermined normal surface level of the liquid bath for continuously feeding liquid into the tank; and c. outlet means arranged at the predetermined normal surface level of the liquid bath for continuously draining liquid from the tank, the outlet means including a plurality of outlets connected to a common drain, the outlets being divided into a pair of sets, with each of the outlets of each one of the sets being connected together as well as to the common drain, the tank having a bottom wall and opposed sidewalls extending codirectionally from the bottom wall, with the outlets being provided in the sidewalls, one of the sets of outlets being disposed in one of the sidewalls and the other of the sets of outlets being disposed in the other of the sidewalls, with the inlet means being arranged adjacent the sidewalls.

2. A structure as defined in claim 1, wherein the inlet means includes a plurality of inlets connected to a common source of liquid.

3. A structure as defined in claim 2, wherein the inlets are divided into a pair of sets, with each of the inlets of each one of the sets being connected together, the inlets being provided in the bottom wall.

4. A structure as defined in claim 3, wherein each of the sets of the inlets are arranged parallel to and adjacent a respective one of the sidewalls.

5. A structure as defined in claim 4, wherein each of the outlets includes a slot provided in the sidewall associated with the respective outlet and arranged substantially coplanar with each other outlet slot, and a converging chamber provided within the associated sidewall and arranged converging away from the slot associated with the chamber, with the outlet means further including a pair of discharge passages, one of the passages provided within one of the sidewalls and the other of the discharge passages provided within the other of the sidewalls, with the discharge passages being connected to the converging chambers at portions thereof spaced from the respective slots, and sloped away from the bottom wall of the tank in a direction away from the drain and toward the converging chambers.

6. A structure as defined in claim 1, wherein each of the outlets includes a slot provided in the sidewall associated with the respective outlet and arranged substantially coplanar with each other outlet slot, and a converging chamber provided within the associated sidewall and arranged converging away from the slot associated with the chamber, with the outlet means further including a pair of discharge passages, one of the passages provided within one of the sidewalls and the other of the discharge passages provided within the other of the sidewalls, with the discharge passages being connected to the converging chambers at portions thereof spaced from the respective slots, and sloped away from the bottom wall of the tank in a direction away from the drain and toward the converging chambers.

7. A therapeutic constant flow bath, comprising, in combination:

a. a tank defined by a bottom wall and an upstanding peripheral wall forming a container for a liquid bath;

b. inlet means disposed below a predetermined normal surface level of the liquid bath for continuously feeding liquid into the tank; and c. outlet means in the peripheral wall arranged at the predetermined normal surface level of the liquid bath for continuously draining liquid from the tank, said inlet means including a plurality of inlets connected to a common source of liquid, said outlet means including a plurality of outlets connected to a common drain, said outlets being disposed in the peripheral wall above the bottom wall, said outlets being disposed at opposite sides of the tank and said inlets being disposed adjacent the periphery of the tank.

8. The structure as defined in claim 7 wherein said tank is rectangular with opposed, parallel side walls, the outlets being disposed in longitudinally spaced relation in said opposed side walls, said outlets being in the form of horizontally elongated slots, said inlets being disposed in the bottom wall and in adjacent relation to the opposed side walls.

* * * * *